US011408224B2

(12) United States Patent
De La Porte

(10) Patent No.: US 11,408,224 B2
(45) Date of Patent: Aug. 9, 2022

(54) FOLDABLE DOOR

(71) Applicant: Pete De La Porte, Elyria, OH (US)

(72) Inventor: Pete De La Porte, Elyria, OH (US)

( * ) Notice: Subject to any disclaimer, the term of this patent is extended or adjusted under 35 U.S.C. 154(b) by 0 days.

(21) Appl. No.: 17/139,191

(22) Filed: Dec. 31, 2020

(65) Prior Publication Data

US 2021/0207434 A1 Jul. 8, 2021

Related U.S. Application Data

(60) Provisional application No. 62/957,046, filed on Jan. 3, 2020.

(51) Int. Cl.
*E06B 9/52* (2006.01)
*E06B 9/06* (2006.01)

(52) U.S. Cl.
CPC ..... *E06B 9/52* (2013.01); *E06B 9/0692* (2013.01); *E06B 2009/527* (2013.01)

(58) Field of Classification Search
CPC ..... E06B 9/52; E06B 9/522; E06B 2009/527; E06B 9/0692; E06B 9/06; E06B 7/03; E06B 3/48
USPC ..... 160/369, 377, 379
See application file for complete search history.

(56) References Cited

U.S. PATENT DOCUMENTS 1,131,204 A * 3/1915 Bridges ..... E06B 9/52 160/372
3,455,366 A * 7/1969 Bogumil ..... E06B 9/52 160/368.1
5,123,474 A * 6/1992 Smith ..... E06B 9/13 160/273.1
5,611,382 A * 3/1997 Sferra ..... E06B 9/52 160/113
6,036,249 A * 3/2000 Kuntz ..... B60Q 7/00 160/135
6,098,698 A * 8/2000 King-Darr ..... E06B 9/54 160/23.1
6,191,886 B1 * 2/2001 Sinkoff ..... G03B 21/58 160/24
8,045,264 B2 * 10/2011 Elliott ..... G03B 21/62 359/443
2012/0186755 A1 * 7/2012 Sessa ..... E06B 9/54 160/239
2014/0290873 A1 * 10/2014 Altieri, Jr. ..... E06B 9/0692 160/105
2014/0360687 A1 * 12/2014 Ogilvie ..... E04H 15/005 160/377
2019/0346095 A1 * 11/2019 Brown ..... E05F 15/668

* cited by examiner

*Primary Examiner* — Brent W Herring
(74) *Attorney, Agent, or Firm* — Wentsler LLC

(57) ABSTRACT

A garage door apparatus includes a screen that includes a flexible, perforated material. The garage door apparatus includes a first attachment arm attached to a first portion of a second side of the screen. The garage door apparatus includes a second attachment arm attached to a second portion of the second side of the screen. The garage door apparatus includes a third attachment arm attached to a first portion of a fourth side of the screen. The garage door apparatus includes a fourth attachment arm attached to a second portion of the fourth side of the screen. The garage door apparatus includes an attachment bar attached to the third side of the screen. The screen is movable between a retracted position and an extended position.

17 Claims, 9 Drawing Sheets

FOLDABLE DOOR

CROSS-REFERENCE TO RELATED APPLICATIONS

This application claims the benefit of priority of U.S. Provisional Patent Application No. 62/957,046, titled "FOLDABLE DOOR," filed on Jan. 3, 2020, the entire disclosure of which is hereby incorporated by reference.

FIELD

The present application relates generally to a foldable door and more particularly to a foldable garage door.

BACKGROUND

Doors can be used in a variety of applications, for example, for covering an opening in a garage door. However, existing doors that are made out of wood or metal are costly and difficult to fabricate.

SUMMARY

The following presents a simplified summary of the disclosure to provide a basic understanding of some embodiments described in the detailed description.

In some embodiments, a garage door apparatus comprises a screen comprising a first side, a second side, a third side, and a fourth side. The first side is attached to an edge of a garage door opening. The second side, the third side, and the fourth side are movable relative to the first side. The screen comprises a flexible, perforated material. The garage door apparatus comprises a first attachment arm extending between a first end and a second end. The first end is attached to the edge of the garage door opening and the second end projects into the garage door opening. The first attachment arm is attached to a first portion of the second side of the screen. The garage door apparatus comprises a second attachment arm extending between a third end and a fourth end. The third end is attached to the second end of the first attachment arm. The second attachment arm is attached to a second portion of the second side of the screen. The garage door apparatus comprises a third attachment arm extending between a fifth end and a sixth end. The fifth end is attached to the edge of the garage door opening and the sixth end projects into the garage door opening. The third attachment arm is attached to a first portion of the fourth side of the screen. The garage door apparatus comprises a fourth attachment arm extending between a seventh end and an eighth end. The seventh end is attached to the sixth end of the third attachment arm. The fourth attachment arm is attached to a second portion of the fourth side of the screen. The garage door apparatus comprises an attachment bar attached to the third side of the screen and extends across the garage door opening between a first bar end and a second bar end. The first bar end is attached to the fourth end of the second attachment arm and the second bar end is attached to the eighth end of the fourth attachment arm. The screen is movable between a retracted position, in which the screen is located along the edge of the garage door opening such that the garage door opening is uncovered and the first attachment arm, the second attachment arm, the third attachment arm, the fourth attachment arm, and the attachment bar extend parallel to each other adjacent to the edge of the garage door opening, and an extended position, in which the screen extends from the edge to cover the garage door opening and the attachment bar extends along a second edge that is opposite the edge.

In some embodiments, the first attachment arm and the second attachment arm are colinear when the screen is in the extended position.

In some embodiments, the first attachment arm and the second attachment arm are substantially parallel to and adjacent to a third edge of the garage door opening.

In some embodiments, the first attachment arm and the second attachment arm are non-colinear when the screen is in the retracted position.

In some embodiments, an attachment structure attaches the second attachment arm and the attachment bar, the attachment structure comprising a hinged portion wherein the second attachment arm is pivotable relative to the attachment bar.

In some embodiments, the attachment structure comprises a first attachment portion attached to the attachment bar and a second attachment portion attached to the second attachment arm.

In some embodiments, a garage door apparatus comprises a screen comprising a first side, a second side, a third side, and a fourth side. The first side is attached to an edge of a garage door opening. The second side, the third side, and the fourth side are movable relative to the first side. The screen comprises a flexible, perforated material. The garage door apparatus comprises a first attachment arm extending between a first end and a second end. The first end is attached to the edge of the garage door opening and the second end projects into the garage door opening. The first attachment arm is attached to a first portion of the second side of the screen. The garage door apparatus comprises a second attachment arm extending between a third end and a fourth end. The third end is attached to the second end of the first attachment arm. The second attachment arm is attached to a second portion of the second side of the screen. The garage door apparatus comprises a third attachment arm extending between a fifth end and a sixth end. The fifth end is attached to the edge of the garage door opening and the sixth end projects into the garage door opening. The third attachment arm is attached to a first portion of the fourth side of the screen. The garage door apparatus comprises a fourth attachment arm extending between a seventh end and an eighth end. The seventh end is attached to the sixth end of the third attachment arm. The fourth attachment arm is attached to a second portion of the fourth side of the screen. The garage door apparatus comprises an attachment bar attached to the third side of the screen and extending across the garage door opening between a first bar end and a second bar end. The first bar end is attached to the fourth end of the second attachment arm and the second bar end is attached to the eighth end of the fourth attachment arm. The screen is movable between a retracted position, in which the screen is located along the edge of the garage door opening such that the garage door opening is uncovered, and an extended position, in which the screen extends from the edge to cover the garage door opening and the attachment bar extends along a second edge that is opposite the edge.

In some embodiments, the first attachment arm and the second attachment arm are colinear when the screen is in the extended position.

In some embodiments, the first attachment arm and the second attachment arm are substantially parallel to and adjacent to a third edge of the garage door opening.

In some embodiments, the first attachment arm and the second attachment arm are non-colinear when the screen is in the retracted position.

In some embodiments, an attachment structure attaches the second attachment arm and the attachment bar, the attachment structure comprising a hinged portion wherein the second attachment arm is pivotable relative to the attachment bar.

In some embodiments, the attachment structure comprises a first attachment portion attached to the attachment bar and a second attachment portion attached to the second attachment arm.

In some embodiments, a garage door apparatus comprises a screen comprising a first side, a second side, a third side, and a fourth side. The first side is attached to an edge of a garage door opening. The second side, the third side, and the fourth side are movable relative to the first side. The screen comprises a flexible, perforated material. The garage door apparatus comprises a first lateral support arm attached at one end to the edge of the garage door opening and at an opposing end to a first bar end of an attachment bar. The first lateral support arm is attached to the second side of the screen. The garage door apparatus comprises a second lateral support arm attached at one end to the edge of the garage door opening and at an opposing end to a second bar end of the attachment bar. The second lateral support arm is attached to the fourth side of the screen. The attachment bar is attached to the third side of the screen and extends across the garage door opening between the first bar end and the second bar end. The screen is configured to move between a retracted position, in which the screen is compressed such that the garage door opening is uncovered by the screen, and an extended position, in which the screen extends from the edge to cover the garage door opening such that the screen is substantially planar.

In some embodiments, the first lateral support arm extends linearly when the screen is in the extended position.

In some embodiments, the first lateral support arm is substantially parallel to and adjacent to a third edge of the garage door opening.

In some embodiments, the first lateral support arm is non-linear when the screen is in the retracted position.

In some embodiments, an attachment structure attaches the first lateral support arm and the attachment bar, the attachment structure comprising a hinged portion wherein the first lateral support arm is pivotable relative to the attachment bar.

In some embodiments, the attachment structure comprises a first attachment portion attached to the attachment bar and a second attachment portion attached to the first lateral support arm.

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings. It is to be understood that both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

BRIEF DESCRIPTION OF THE DRAWINGS

These and other features, embodiments and advantages are better understood when the following detailed description is read with reference to the accompanying drawings, in which.

DETAILED DESCRIPTION

Figure 1:
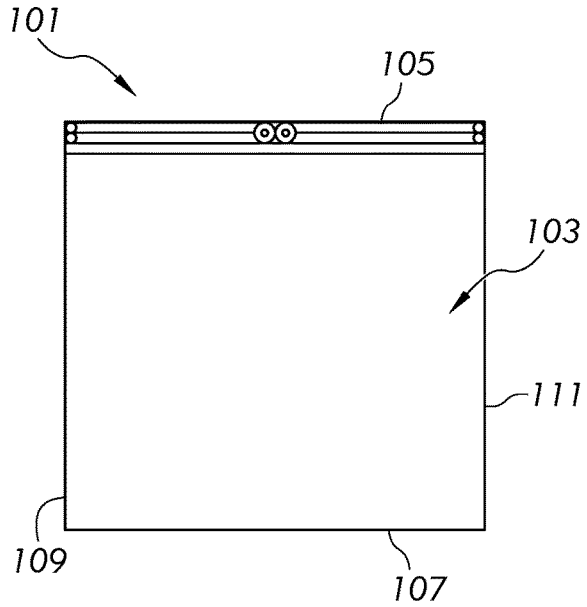
FIG. 1 schematically illustrates a garage door apparatus in accordance with embodiments of the disclosure.

Embodiments will now be described more fully hereinafter with reference to the accompanying drawings in which example embodiments are shown. Whenever possible, the same reference numerals are used throughout the drawings to refer to the same or like parts. However, this disclosure may be embodied in many different forms and should not be construed as limited to the embodiments set forth herein.

As used herein, the term "about" means that amounts, sizes, formulations, parameters, and other quantities and characteristics are not, and need not be, exact, but may be approximate and/or larger or smaller, as desired, reflecting tolerances, conversion factors, rounding off, measurement error and the like, and other factors known to those of skill in the art.

Ranges can be expressed herein as from "about" one value, and/or to "about" another value. When such a range is expressed, another embodiment includes from the one value to the other value. Similarly, when values are expressed as approximations by use of the antecedent "about," it will be understood that the value forms another embodiment. It will be further understood that the endpoints of each of the ranges are significant both in relation to the other endpoint, and independently of the other endpoint.

Directional terms as used herein—for example up, down, right, left, front, back, top, bottom, upper, lower, etc.—are made only with reference to the figures as drawn and are not intended to imply absolute orientation.

Unless otherwise expressly stated, it is in no way intended that any method set forth herein be construed as requiring that its steps be performed in a specific order, nor that with any apparatus, specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

As used herein, the singular forms "a," "an" and "the" include plural references unless the context clearly dictates otherwise. Thus, for example, reference to "a" component includes aspects having two or more such components, unless the context clearly indicates otherwise.

The word "exemplary," "example," or various forms thereof are used herein to mean serving as an example, instance, or illustration. Any aspect or design described herein as "exemplary" or as an "example" should not be construed as preferred or advantageous over other aspects or designs. Furthermore, examples are provided solely for purposes of clarity and understanding and are not meant to limit or restrict the disclosed subject matter or relevant portions of this disclosure in any manner. It can be appreciated that a myriad of additional or alternate examples of varying scope could have been presented but have been omitted for purposes of brevity.

As used herein, the terms "comprising" and "including", and variations thereof, shall be construed as synonymous and open-ended, unless otherwise indicated. A list of elements following the transitional phrases comprising or including is a non-exclusive list, such that elements in addition to those specifically recited in the list may also be present.

The terms "substantial," "substantially," and variations thereof as used herein are intended to represent that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

Modifications may be made to the instant disclosure without departing from the scope or spirit a the claimed subject matter. Unless specified otherwise, "first," "second," or the like are not intended to imply a temporal aspect, a spatial aspect, an ordering, a quantity, etc. Rather, such terms are merely used as identifiers, names, etc. for features, elements, items, etc. For example, a first end and a second end generally correspond to end A and end B or two different or two identical ends or the same end.

The present disclosure relates to a garage door apparatus 101 for covering a garage door opening 103. For example, referring to FIGS. 1-3, the garage door apparatus 101 can comprise one or more structures (e.g., a screen, attachment arms, etc.) that can be moved between a plurality of positions, wherein in some positions (e.g., a retracted position), the garage door apparatus 101 may not cover the garage door opening 103, and in other positions (e.g., an extended position), the garage door apparatus 101 may cover the garage door opening 103. In some embodiments, the garage door opening 103 can comprise a space, a gap, a hole, etc. within a wall of a garage that allows for the ingress/egress of objects (e.g., vehicles, people, equipment, etc.). When a door or screen (e.g., or the garage door apparatus 101) covers the garage door opening 103, then the ingress/egress of objects through the garage door opening 103 is prevented, and when the door or screen (e.g., or the garage door apparatus 101) is retracted and does not cover the garage door opening 103, then the ingress/egress of objects through the garage door opening 103 is permitted.

Figure 3:
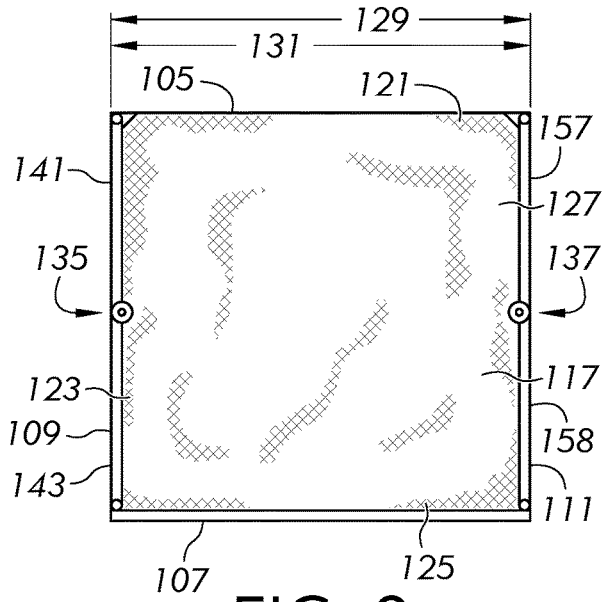
FIG. 3 schematically illustrates a garage door apparatus in accordance with embodiments of the disclosure.
Figure 2:
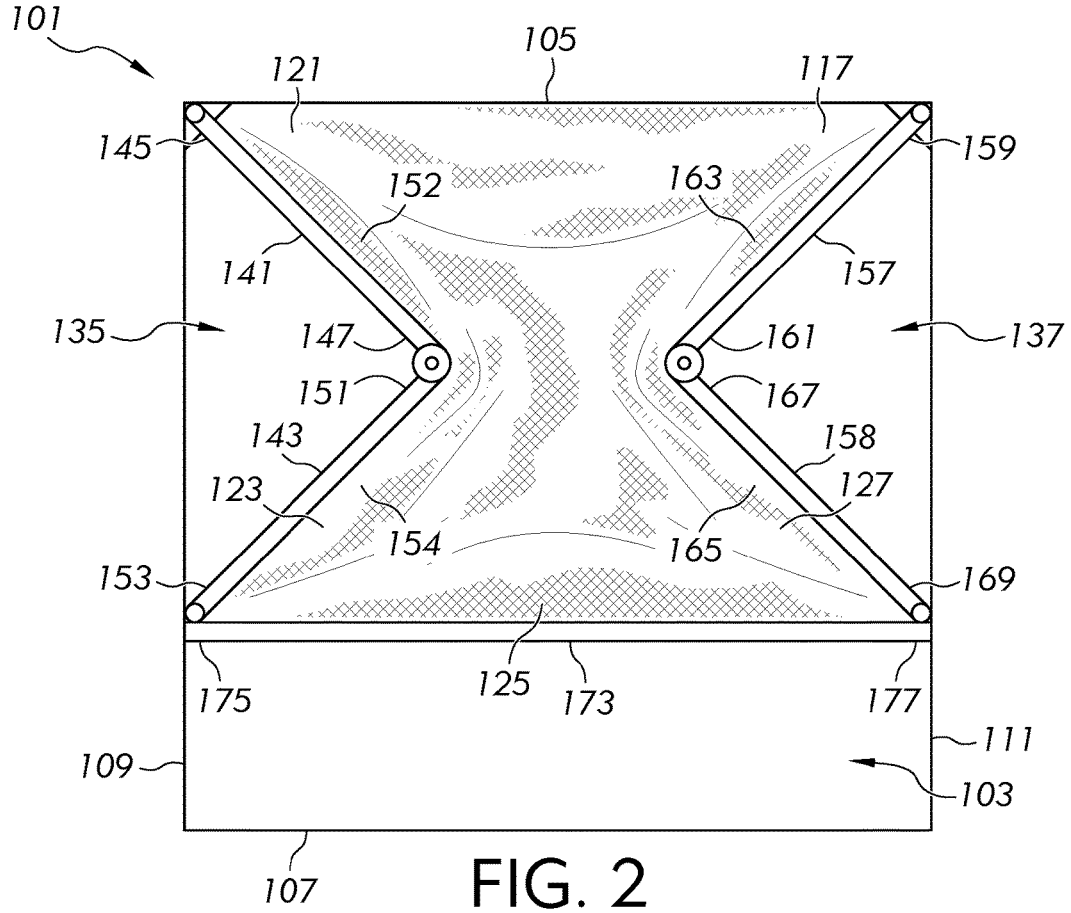
FIG. 2 schematically illustrates a garage door apparatus in accordance with embodiments of the disclosure.

The garage door opening 103 can comprise several sizes and shapes, for example, a quadrilateral shape (e.g., rectangular, square, etc.), a circular shape, an oval, shape, etc. In the embodiments of FIGS. 1-3, the garage door opening 103 can comprise a square shape. The garage door opening 103 may be defined by one or more edges, for example, an edge 105, a second edge 107, a third edge 109, and a fourth edge 111. The edges 105, 107, 109, 111 may, in some embodiments, comprise portions of a wall within which the garage door opening 103 is defined, such that the edges 105, 107, 109, 111 border and define the garage door opening 103. In some embodiments, the edge 105 may be located at an upper side of the garage door opening 103. The second edge 107 may be located at a bottom side of the garage door opening 103 (e.g., wherein the second edge 107 may comprise a part of a floor). The edge 105 and the second edge 107 may be spaced apparat and located at opposing sides of the garage door opening 103 such that the garage door opening 103 may be located between the edge 105 (e.g., at an upper or top side relative to a gravitational direction) and the second edge 107 (e.g., at a lower or bottom side relative to the gravitational direction). The third edge 109 and the fourth edge 111 may be located at adjacent lateral sides of the garage door opening 103. For example, the third edge 109 and the fourth edge 111 can be spaced apart with the garage door opening 103 located in between. In some embodiments, the third edge 109 can extend between the edge 105 and the second edge 107 (e.g., at one end of the edge 105 and the second edge 107) while the fourth edge 111 can extend between the edge 105 and the second edge 107 (e.g., at an opposing end of the edge 105 and the second edge 107). In some embodiments, the edge 105 and the second edge 107 can extend substantially horizontally while the third edge 109 and the fourth edge 111 can extend substantially vertically.

The edges 105, 107, 109, 111 are not limited to comprising portions of a wall within which the garage door opening 103 is defined. For example, in some embodiments, one or more of the edges 105, 107, 109, 111 can comprise a structure that is not a wall, such as, for example, a door. For example, in some embodiments, the edge 105 can comprise a portion of a separate garage door that can selectively cover the garage door opening 103. As such, when the separate garage door is opened (e.g., raised), then the edge 105 may be defined by a bottom of the separate garage door.

The garage door apparatus 101 can comprise one or more structures for selectively covering the garage door opening 103. For example, the garage door apparatus 101 can comprise a screen 117. The screen 117 can comprise a flexible, perforated, and semi-permeable material. For example, the flexible, perforated, and semi-permeable material can comprise a mesh screen that comprises a plurality of openings that are separated by connected strands of an interlaced material such as metal, fiber, etc. Due to the screen 117 comprising the perforated and semi-permeable material, the screen 117 can selectively allow for air to pass through the screen 117 while limiting the passage of larger particles (e.g., particles that are larger than the openings in the screen 117), such as animals (e.g., insects, birds, etc.), debris (e.g., leaves, seeds, etc.), or other items. The screen 117 can therefore provide a cover to the garage door opening 103. In some embodiments, the screen 117 can be flexible such that the screen 117 is capable of being bent easily without breaking, and wherein the screen 117 can be moved between multiple positions (e.g., bent/folded positions, extended flattened positions, etc.) without breaking or retaining a shape. In some embodiments, the screen 117 is not limited to comprising the flexible, perforated, and semi-permeable material. Rather, in some embodiments, the screen 117 can comprise a vinyl material (e.g., that is non-perforated and does not comprise openings) that is substantially solid.

The screen 117 can comprise one or more sides. For example, in some embodiments, the screen 117 can comprise a first side 121, a second side 123, a third side 125, and a fourth side 127. In some embodiments, the first side 121 can be attached to the edge 105 of the garage door opening 103. For example, by being attached to the edge 105, the first side 121 can be attached to a wall that defines the garage door opening 103, or another structure (e.g., a separate garage door). In these embodiments, by being attached to the edge 105, the first side 121 can remain in position relative to the garage door opening 103.

The second side 123, the third side 125, and the fourth side 127 of the screen 117 can be movable relative to the first side 121. For example, by being movable relative to the first side 121, the second side 123, the third side 125, and the fourth side 127 can move (e.g., slide, translate, pivot, etc.) relative to the first side 121 such that the second side 123, the third side 125, and the fourth side 127 can move between a retracted position (e.g., illustrated in FIG. 1) and an extended position (e.g., illustrated in FIG. 3). In some embodiments, the screen 117 can comprise a width 129 that may substantially match a width 131 of the garage door opening 103. For example, the width 129 of the screen 117 can be measured in a direction that is parallel to the first side 121 (e.g., between the second side 123 and the fourth side 127) when the screen 117 is in an extended position. The width 131 of the garage door opening 103 can be measured between the third edge 109 and the fourth edge 111. In some embodiments, by substantially matching the width 129 of the screen 117 to the width 131 of the garage door opening 103, the screen 117 can cover substantially all of the garage door opening 103 when the screen 117 is in the extended position. In this way, the screen 117 can limit particles or materials from passing through the garage door opening 103 when the screen 117 is in the extended position.

The garage door apparatus 101 can comprise one or more lateral support arms such as, for example, a first lateral support arm 135 and a second lateral support arm 137. The first lateral support arm 135 can be attached to the second side 123 of the screen 117 while the second lateral support arm 137 can be attached to the fourth side 127 of the screen 117. The first lateral support arm 135 and the second lateral support arm 137 can be spaced apart and may be movable between a retracted position (e.g., illustrated in FIG. 1) and the extended position (e.g., illustrated in FIG. 3). In the retracted position, the first lateral support arm 135 and the second lateral support arm 137 can extend non-linearly, for example, by being in a bent configuration (e.g., illustrated in FIG. 1). In the extended position, the first lateral support arm 135 may be located adjacent to the third edge 109 while the second lateral support arm 137 may be located adjacent to the fourth edge 111.

In some embodiments, the first lateral support arm 135 can comprise one or more attachment arms, for example, a first attachment arm 141 and a second attachment arm 143. The first attachment arm 141 can extend between a first end 145 and a second end 147. In some embodiments, the first attachment arm 141 can comprise an inflexible material (e.g., metal, plastic, wood, etc.) that may be resistant to bending and/or breaking, with the first attachment arm 141 extending substantially linearly between the first end 145 and the second end 147. The first end 145 can be attached to the edge 105 of the garage door opening 103 and the second end 147 can project into the garage door opening 103 (e.g., see FIG. 2) when the screen 117 is moved between the retracted position and the extended position. The first attachment arm 141 can be attached to a first portion 152 of the second side 123 of the screen 117. For example, the first portion 152 of the second side 123 of the screen 117 can comprise an upper part (e.g., an upper half) of the second side 123 of the screen 117, with the first attachment arm 141 attached to the first portion 152 (e.g., for example, with mechanical fasteners, adhesives, etc.). As will be described herein, the first end 145 can be attached to the edge 105 in several ways, for example, to allow movement between the first attachment arm 141 and the edge 105. For example, in some embodiments, the first end 145 can be pivotably attached to the edge 105 such that the first attachment arm 141 can pivot relative to the edge 105 between the retracted position (e.g., illustrated in FIG. 1), an intermediate position (e.g., illustrated in FIG. 2), and the extended position (e.g., illustrated in FIG. 3).

The second attachment arm 143 can extend between a third end 151 and a fourth end 153. In some embodiments, the second attachment arm 143 can comprise an inflexible material (e.g., metal, plastic, wood, etc.) that may be resistant to bending and/or breaking, with the second attachment arm 143 extending substantially linearly between the third end 151 and the fourth end 153. The third end 151 can be attached to the second end 147 of the first attachment arm 141. The third end 151 can be attached to the second end 147 in several ways, for example, to allow movement between the second attachment arm 143 and the first attachment arm 141. For example, in some embodiments, the third end 151 can be pivotably attached to the second end 147 such that the second attachment arm 143 can pivot relative to the first attachment arm 141 between the retracted position (e.g., illustrated in FIG. 1), an intermediate position (e.g., illustrated in FIG. 2), and the extended position (e.g., illustrated in FIG. 3). The second attachment arm 143 can be attached to a second portion 154 of the second side 123 of the screen 117. For example, the second portion 154 of the second side 123 of the screen 117 can comprise a lower part (e.g., a lower half) of the second side 123 of the screen 117, with the second attachment arm 143 attached to the second portion 154 (e.g., for example, with mechanical fasteners, adhesives, etc.).

Referring to the second lateral support arm 137, the second lateral support arm 137 can comprise one or more attachment arms, for example, a third attachment arm 157 and a fourth attachment arm 158. The third attachment arm 157 can extend between a fifth end 159 and a sixth end 161. In some embodiments, the third attachment arm 157 can comprise an inflexible material (e.g., metal, plastic, wood, etc.) that may be resistant to bending and/or breaking, with the third attachment arm 157 extending substantially linearly between the fifth end 159 and the sixth end 161. The fifth end 159 can be attached to the edge 105 of the garage door opening 103 and the sixth end 161 can project into the garage door opening 103 (e.g., see FIG. 2) when the screen 117 is moved between the retracted position and the extended position. The third attachment arm 157 can be attached to a first portion 163 of the fourth side 127 of the screen 117. For example, the first portion 163 of the fourth side 127 of the screen 117 can comprise an upper part (e.g., an upper half) of the fourth side 127 of the screen 117, with the third attachment arm 157 attached to the first portion 163 (e.g., for example, with mechanical fasteners, adhesives, etc.). As will be described herein, the fifth end 159 can be attached to the edge 105 in several ways, for example, to allow movement between the third attachment arm 157 and the edge 105. For example, in some embodiments, the fifth end 159 can be pivotably attached to the edge 105 such that the third attachment arm 157 can pivot relative to the edge 105 between the retracted position (e.g., illustrated in FIG. 1), an intermediate position (e.g., illustrated in FIG. 2), and the extended position (e.g., illustrated in FIG. 3).

The fourth attachment arm 158 can extend between a seventh end 167 and an eighth end 169. In some embodiments, the fourth attachment arm 158 can comprise an inflexible material (e.g., metal, plastic, wood, etc.) that may be resistant to bending and/or breaking, with the fourth attachment arm 158 extending substantially linearly between the seventh end 167 and the eighth end 169. The seventh end 167 can be attached to the sixth end 161 of the third attachment arm 157. The seventh end 167 can be attached to the sixth end 161 in several ways, for example, to allow movement between the fourth attachment arm 158 and the third attachment arm 157. For example, in some embodiments, the seventh end 167 can be pivotably attached to the sixth end 161 such that the fourth attachment arm 158 can pivot relative to the third attachment arm 157 between the retracted position (e.g., illustrated in FIG. 1), an intermediate position (e.g., illustrated in FIG. 2), and the extended position (e.g., illustrated in FIG. 3). The fourth attachment arm 158 can be attached to a second portion 165 of the fourth side 127 of the screen 117. For example, the second portion 165 of the fourth side 127 of the screen 117 can comprise a lower part (e.g., a lower half) of the fourth side 127 of the screen 117, with the fourth attachment arm 158 attached to the second portion 165 (e.g., for example, with mechanical fasteners, adhesives, etc.).

In some embodiments, the garage door apparatus 101 can comprise an attachment bar 173 that may be attached to the third side 125 of the screen 117. The attachment bar 173 can extend across the garage door opening 103 between a first bar end 175 and a second bar end 177. The first bar end 175 may be attached to the fourth end 153 of the second attachment arm 143, and the second bar end 177 can be attached to the eighth end 169 of the fourth attachment arm 158. In some embodiments, the attachment bar 173 can comprise an inflexible material (e.g., metal, plastic, wood, etc.) that may be resistant to bending and/or breaking. The attachment bar 173 can extend substantially linearly between the first bar end 175 and the second bar end 177. In some embodiments, the attachment bar 173 can comprise a length that may substantially match the width 129 of the screen 117 and the width 131 of the garage door opening 103. As such, the attachment bar 173 can extend across substantially all of the width 131 of the garage door opening 103, with the first bar end 175 located adjacent to and/or in contact with the third edge 109, and the second bar end 177 located adjacent to and/or in contact with the fourth edge 111.

The attachment bar 173 can be attached to the second attachment arm 143 and the fourth attachment arm 158 in several ways, for example, to allow movement between the attachment bar 173 and the second attachment arm 143 and the fourth attachment arm 158. For example, in some embodiments, the first bar end 175 can be pivotably attached to the fourth end 153 such that the attachment bar 173 can pivot relative to the second attachment arm 143 between the retracted position (e.g., illustrated in FIG. 1), an intermediate position (e.g., illustrated in FIG. 2), and the extended position (e.g., illustrated in FIG. 3). Similarly, in some embodiments, the second bar end 177 can be pivotably attached to the eighth end 169 such that the attachment bar 173 can pivot relative to the fourth attachment arm 158 between the retracted position (e.g., illustrated in FIG. 1), an intermediate position (e.g., illustrated in FIG. 2), and the extended position (e.g., illustrated in FIG. 3). Accordingly, in some embodiments, the attachment bar 173 can remain either parallel to the edge 105 (e.g., and the second edge 107), or may be non-parallel to the edge 105 (e.g., and the second edge 107).

In some embodiments, the attachment bar 173 can comprise a relatively heavy material such that the attachment bar 173 may be resistant to the elemental forces (e.g., wind, rain, snow, etc.) that may act upon the screen 117. For example, when the attachment bar 173 is in the extended position (e.g., illustrated in FIG. 3) such that the screen 117 covers the garage door opening 103), the attachment bar 173 may be in contact with the second edge 107, such as, for example, resting upon the second edge 107. In this way, the second edge 107 (e.g., the ground or a floor of the garage door) can support the attachment bar 173. Due to the weight of the attachment bar 173, the attachment bar 173 may tend to remain in place and may be resistant to movement into or out of the garage door. As such, when an elemental force acts upon the screen 117, such as, for example, wind blowing upon the screen 117, the attachment bar 173 may maintain the screen 117 in a position that covers the garage door opening 103 while not blowing into the garage.

In some embodiments, the screen 117 may be movable between a retracted position (e.g., illustrated in FIG. 1), in which the screen 117 may be located along the edge 105 of the garage door opening 103 such that the garage door opening 103 is uncovered (e.g., uncovered by the screen 117), and wherein the first attachment arm 141, the second attachment arm 143, the third attachment arm 157, the fourth attachment arm 158, and the attachment bar 173 can extended parallel to each other adjacent to the edge 105 of the garage door opening 103. For example, by extending parallel to each other, in some embodiments, the first attachment arm 141, the second attachment arm 143, the third attachment arm 157, the fourth attachment arm 158, and the attachment bar 173 may be parallel to one another while also being parallel to the edge 105. In the retracted position, the screen 117 may be not fully-extended (e.g., crumpled, creased, wrinkled, condensed, etc.) and, instead, may be located adjacent to the edge 105 while not extending across the garage door opening 103 toward the second edge 107. The screen 117 may be movable from the retracted position to the extended position (e.g., illustrated in FIG. 3), in which the screen 117 can extend from the edge 105 to cover the garage door opening 103, and the attachment bar 173 can extend along the second edge 107 that is opposite the edge 105. For example, in the extended position, the screen 117 may be partially or fully extended such that the screen 117 is substantially planar (e.g., lies within a plane) while extending within and covering the garage door opening 103. In the extended position, the sides of the screen 117 can be adjacent to the edges of the garage door opening 103 such that minimal gaps or spaces are located between the screen 117 and the edges of the garage door opening 103. For example, in the extended position, the first side 121 of the screen 117 (e.g., and the first lateral support arm 135 comprising the first attachment arm 141 and the second attachment arm 143) can extend along and adjacent to (and/or in contact with) the third edge 109 of the garage door opening 103. In the extended position, the fourth side 127 of the screen 117 (e.g., and the second lateral support arm 137 comprising the third attachment arm 157 and the fourth attachment arm 158) can extend along and adjacent to (and/or in contact with) the fourth edge 111 of the garage door opening 103. In the extended position, the attachment bar 173 can extend along and adjacent to (and/or in contact with) the second edge 107 of the garage door opening 103. In this way, substantially all (e.g., greater than or equal to about 95%) of the garage door opening 103 may be covered by the garage door apparatus 101.

Figure 10:
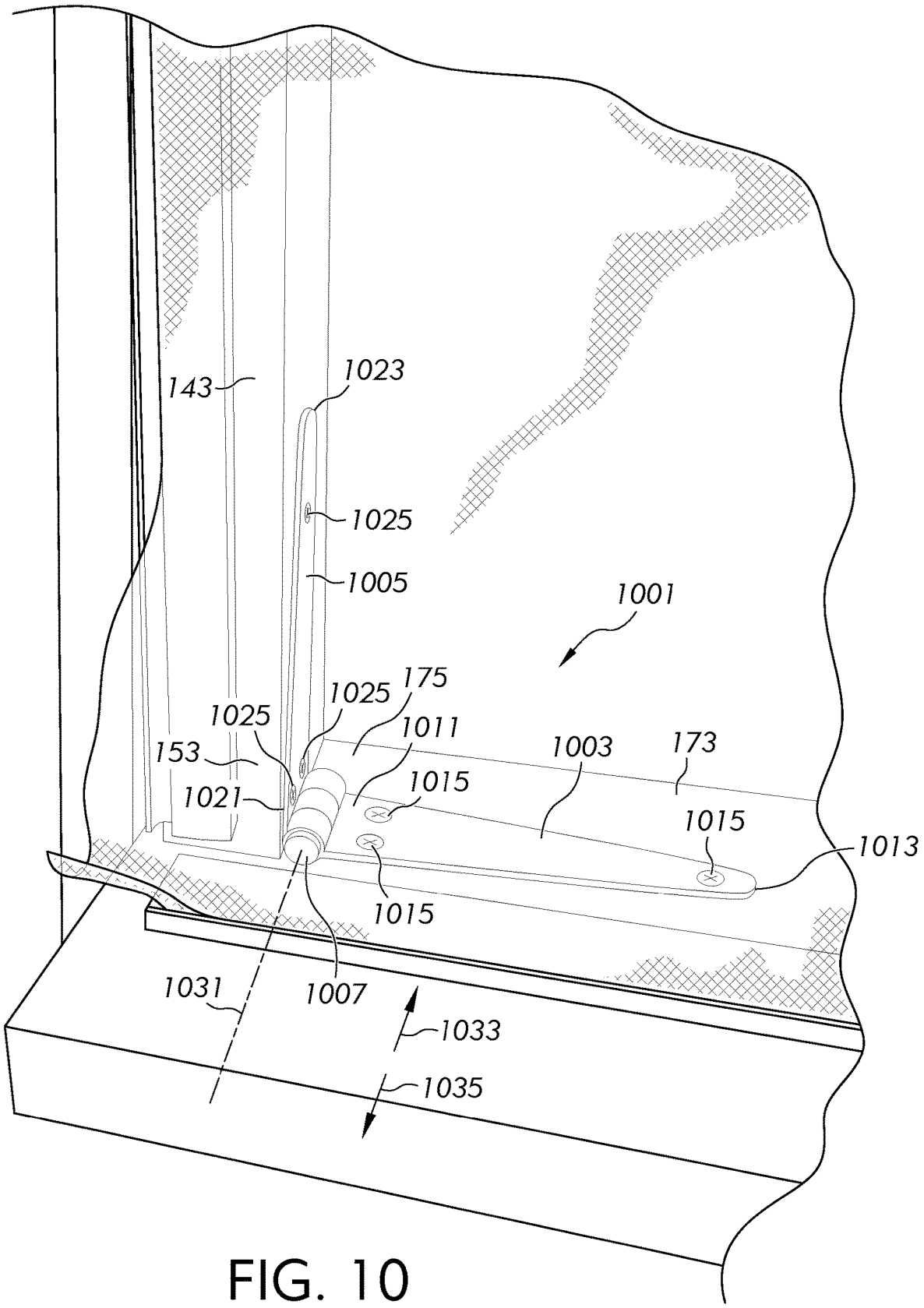
FIG. 10 schematically illustrates a garage door apparatus in accordance with embodiments of the disclosure.

Referring to FIG. 10, an example of an attachment structure 1001 that can attach one or more of the attachment arms 141, 143, 157, 158 and/or the attachment bar 173 is illustrated. For the purposes of illustration, the attachment structure 1001 is illustrated as attaching the first bar end 175 of the attachment bar 173 to the fourth end 153 of the second attachment arm 143. However, the attachment structure 1001 is not limited to attaching the attachment bar 173 and the second attachment arm 143. Rather, in some embodiments, the attachment structure 1001 can be used to attach zero or more of the other attachment arms 141, 143, 157, 158 and/or the attachment bar 173. For example, the attachment structure 1001 can be used to attach the first end 145 of the first attachment arm 141 to the edge 105. In some embodiments, the attachment structure 1001 can be used to attach the second end 147 of the first attachment arm 141 to the third end 151 of the second attachment arm 143. In some embodiments, the attachment structure 1001 can be used to attach the fifth end 159 of the third attachment arm 157 to the edge 105. In some embodiments, the attachment structure 1001 can be used to attach the sixth end 161 of the third attachment arm 157 to the seventh end 167 of the fourth attachment arm 158. In some embodiments, the attachment structure 1001 can be used to attach the eighth end 169 of the fourth attachment arm 158 to the second bar end 177 of the attachment bar 173.

The attachment structure 1001 can comprise a first attachment portion 1003 and a second attachment portion 1005. The attachment structure 1001 can comprise a hinged portion 1007 that may be attached to the first attachment portion 1003 and the second attachment portion 1005, with the hinged portion 1007 allowing pivotable movement of the first attachment portion 1003 and the second attachment portion 1005 relative to each other. For example, referring to the first attachment portion 1003, the first attachment portion 1003 can extend between a first end 1011 and a second end 1013. In some embodiments, the first attachment portion 1003 can comprise a decreasing size (e.g., width) from the first end 1011 toward the second end 1013. The first end 1011 can be attached to the hinged portion 1007 and the second end 1013 can be located a distance apart from the hinged portion 1007. In some embodiments, the attachment structure 1001 can comprise a plurality of first fasteners 1015 (e.g., screws, bolts, etc.) that can attach the first attachment portion 1003 to the first bar end 175 of the attachment bar 173. For example, the first fasteners 1015 can extend through openings in the first attachment portion 1003 and may extend through openings in the attachment bar 173. The first fasteners 1015 can be spaced apart along the length of the first attachment portion 1003, such that one or more of the first fasteners 1015 may be located in closer proximity to the hinged portion 1007 than other of the first fasteners 1015. Such an arrangement of the first fasteners 1015 can provide for a secure attachment of the first attachment portion 1003 and the first bar end 175 of the attachment bar 173, such that relative movement between the attachment bar 173 and the first attachment portion 1003 is limited.

Referring to the second attachment portion 1005, the second attachment portion 1005 can be similar or identical in size, shape, and structure as the first attachment portion 1003. For example, the second attachment portion 1005 can extend between a first end 1021 and a second end 1023. In some embodiments, the second attachment portion 1005 can comprise a decreasing size (e.g., width) from the first end 1021 toward the second end 1023. The first end 1021 can be attached to the hinged portion 1007 and the second end 1023 can be located a distance apart from the hinged portion 1007. In some embodiments, the attachment structure 1001 can comprise a plurality of second fasteners 1025 (e.g., screws, bolts, etc.) that can attach the second attachment portion 1005 to the fourth end 153 of the second attachment arm 143. For example, the second fasteners 1025 can extend through openings in the second attachment portion 1005 and may extend through openings in the second attachment arm 143. The second fasteners 1025 can be spaced apart along the length of the second attachment portion 1005, such that one or more of the second fasteners 1025 may be located in closer proximity to the hinged portion 1007 than other of the second fasteners 1025. Such an arrangement of the second fasteners 1025 can provide for a secure attachment of the second attachment portion 1005 and the fourth end 153 of the second attachment arm 143, such that relative movement between the second attachment arm 143 and the second attachment portion 1005 is limited.

The hinged portion 1007 can extend along a hinge axis 1031, with the first attachment portion 1003 and/or the second attachment portion 1005 rotatable about the hinge axis 1031. For example, the hinge axis 1031 can intersect the hinged portion 1007 and may extend through the garage door opening 103. The hinged portion 1007 can function as a mechanical bearing in which the first attachment portion 1003 and the second attachment portion 1005 can rotate relative to each other about a fixed axis of rotation (e.g., the hinge axis 1031). The hinged portion 1007 can prevent, however, translations or rotations in directions other than about the hinge axis 1031, such that the hinged portion 1007 comprises one degree of freedom. The hinged portion 1007 can therefore prevent movement of the first attachment portion 1003 and the second attachment portion 1005 in other directions, for example, a first direction 1033 and/or a second direction 1035 that are parallel to the hinge axis 1031. Accordingly, the hinged portion 1007 can reduce the likelihood of the elemental forces (e.g., wind, etc.) acting upon the screen 117 and causing the screen 117 to move in the first direction 1033 or the second direction 1035. Similarly, the hinged portion 1007 can facilitate movement of the second attachment arm and the attachment bar, such that the second attachment arm may be pivotable relative to the attachment bar.

As illustrated in FIG. 10, the hinged portion 1007 can facilitate movement of the first attachment portion 1003 and the second attachment portion 1005 as the screen 117 is moved between the retracted position and the extended position. For example, when the screen 117 is in the extended position (e.g., as illustrated in FIG. 3 and FIG. 10), the screen 117 can cover the garage door opening 103 such that an axis traveling parallel to the hinge axis 1031 (e.g., along the first direction 1033 or the second direction 1035)

can intersect the screen 117 upon passing through a center of the garage door opening 103 (e.g., at a midpoint between the edge 105 and the second edge 107, and at a midpoint between the third edge 109 and the fourth edge 111). When the screen 117 is in the retracted position (e.g., as illustrated in FIG. 1), the screen 117 does not cover the garage door opening 103 such that an axis traveling parallel to the hinge axis 1031 (e.g., along the first direction 1033 or the second direction 1035) does not intersect the screen 117 upon passing through a center of the garage door opening 103 (e.g., at a midpoint between the edge 105 and the second edge 107, and at a midpoint between the third edge 109 and the fourth edge 111). In the extended position, the first attachment portion 1003 and the second attachment portion 1005 can form an angle that is within a range from about 70 degrees to about 110 degrees, or within a range from about 80 degrees to about 100 degrees, or about 90 degrees. As such, the first lateral support arm 135 (e.g., and the second lateral support arm 137) and the attachment bar 173 can likewise form an angle that is within a range from about 70 degrees to about 110 degrees, or within a range from about 80 degrees to about 100 degrees, or about 90 degrees. In the retracted position (e.g., illustrated in FIGS. 1 and 4), first attachment portion 1003 and the second attachment portion 1005 may be in close proximity and/or in contact, such that the first attachment portion 1003 and the second attachment portion 1005 can form an angle that is within a range less than about 10 degrees, or about zero degrees. As such, in the retracted position, the first attachment portion 1003 may be substantially parallel to the second attachment portion 1005.

In some embodiments, the first attachment arm 141 and the second attachment arm 143 can be colinear (e.g., extending linearly along the same axis) when the screen 117 is in the extended position. For example, the first attachment arm 141 and the second attachment arm 143 may be substantially parallel to and adjacent to the third edge 109 of the garage door opening 103. As such, in this way, the first lateral support arm 135 can extend linearly and along the same axis when the screen 117 is in the extended position, with the first lateral support arm 135 being substantially parallel to and adjacent to the third edge 109 of the garage door opening 103. In some embodiments, the first attachment arm 141 and the second attachment arm 143 can be non-colinear when the screen 117 is in the retracted position. For example, by being non-colinear, the first attachment arm 141 and the second attachment arm 143 can extend along different axes in the retracted position. As such, in this way, the first lateral support arm 135 can be non-linear when the screen 117 is in the retracted position. The second lateral support arm 137 (e.g., and portions thereof including the third attachment arm and the fourth attachment arm) can be moved in a substantially identical manner.

Figure 9:
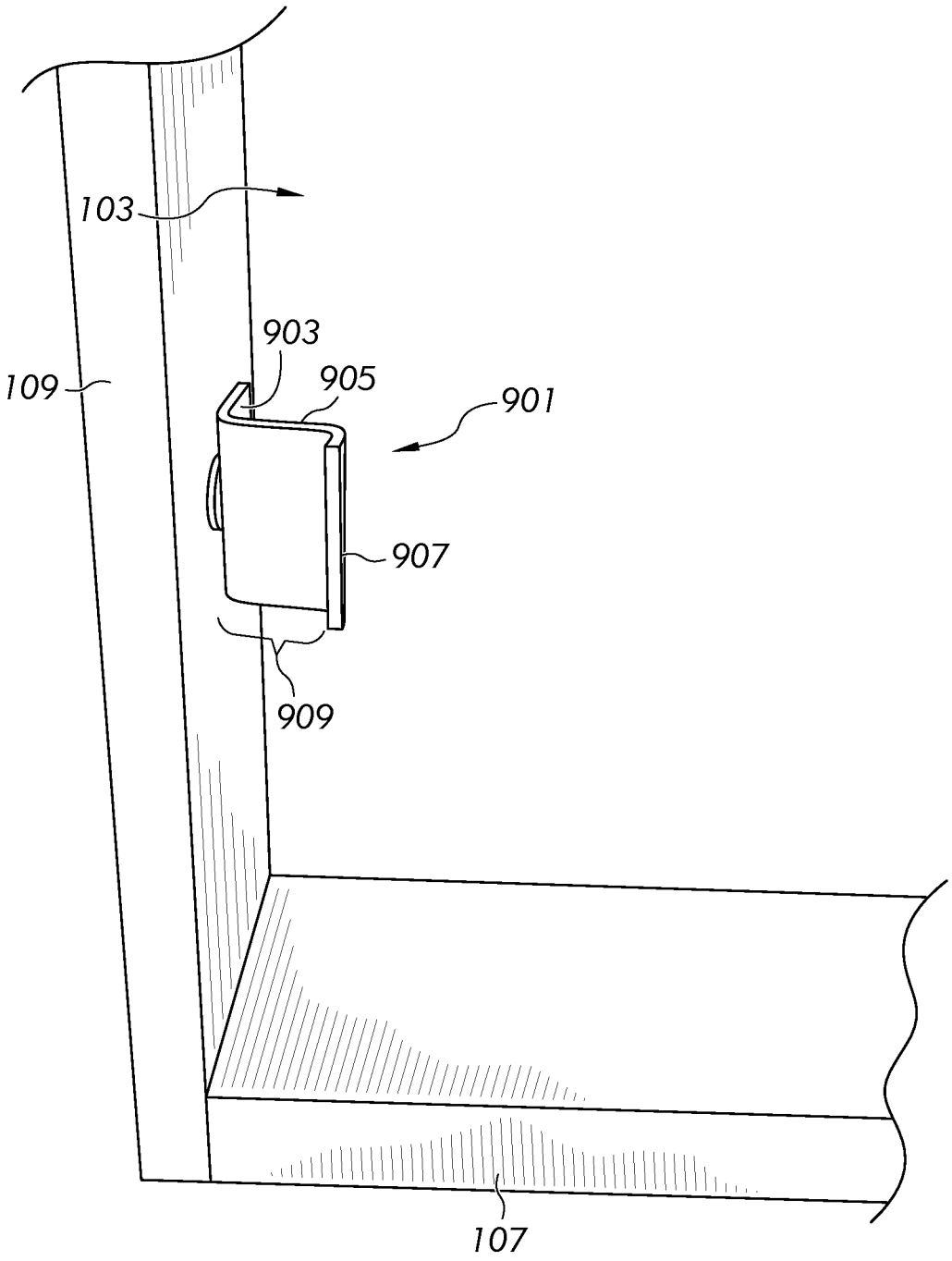
FIG. 9 schematically illustrates a garage door apparatus in accordance with embodiments of the disclosure.

Referring to FIGS. 9 and 10, in some embodiments, the garage door apparatus 101 can comprise one or more structures that can facilitate movement of the screen 117 and assist in maintaining a position of the screen 117 (e.g., in the retracted or extended position). For example, as illustrated in FIG. 9, the garage door apparatus 101 can comprise a support bracket 901 that can hold one of the lateral support arms 135, 137 in place. For the purposes of illustration, the support bracket 901 is illustrated as being attached to the third edge 109, such that the support bracket 901 can support the first lateral support arm 135. However, the support bracket 901 is not limited to attaching the third edge 109, and in some embodiments, additional support brackets 901 can be attached to the second edge 107 and/or the fourth edge 111. For example, a support bracket 901 can be attached to the second edge 107 for supporting the attachment bar 173. In addition, or in the alternative, a support bracket 901 can be attached to the fourth edge 111 for supporting the second lateral support arm 137.

The support bracket 901 can be attached to the third edge 109 at an inner side of the third edge 109 such that the support bracket 901 may extend into the garage door opening 103. In some embodiments, the support bracket 901 can comprise a non-planar shape with a plurality of portions. For example, the support bracket 901 can comprise a first support portion 903, a second support portion 905, and a third support portion 907. The first support portion 903 can comprise a substantially planar shape that may be in contact with the third edge 109. In some embodiments, the first support portion 903 can comprise one or more openings that can receive a fastener. In this way, the fastener can attach the first support portion 903 to the third edge 109, such that the first support portion 903 may be flush with and in contact with the third edge 109. The second support portion 905 can be non-planar relative to the first support portion 903 and can project from the first support portion 903 in a direction away from the third edge 109 (e.g., into the garage door opening 103). For example, in some embodiments, the second support portion 905 can extend in a direction that is substantially perpendicular relative to the first support portion 903, such that an angle formed between the first support portion 903 and the second support portion 905 may be within a range from about 60 degrees to about 120 degrees. In some embodiments, the third support portion 907 can be non-planar relative to the first support portion 903 and the second support portion 905. The third support portion 907 can extend in a direction that is substantially perpendicular relative to the second support portion 905, such that an angle formed between the third support portion 907 and the second support portion 905 may be within a range from about 60 degrees to about 120 degrees (or about 90 degrees). In some embodiments, the third support portion 907 may be substantially parallel to the first support portion 903 while being spaced a distance apart from the first support portion 903. For example, the first support portion 903 can be positioned on one side of the second support portion 905 while the third support portion 907 can be positioned on an opposing side of the second support portion 905. As such, a plane along which the second support portion 905 extends can extend between the first attachment portion 1003 (e.g., positioned on one side of the plane) and the second attachment portion 1005 (e.g., positioned on an opposing side of the plane).

In operation, the support bracket 901 can define a gap 909 positioned between the third support portion 907 and the third edge 109. For example, the gap can be bounded by the third edge 109 and the third support portion 907 at opposing sides, and by the second support portion 905, with a fourth side being unbounded. In this way, the support bracket 901 can receive a portion of the first lateral support arm 135. In some embodiments, the support bracket 901 is located in close proximity to the second edge 107 such that the support bracket 901 can receive the second attachment arm 143 within the gap 909. For example, when the screen 117 is in the extended position, the second attachment arm 143 can be received within the gap 909. Due to the third support portion 907 contacting the second attachment arm 143, the third support portion 907 can maintain the second attachment arm 143 within the gap 909 adjacent to the third edge 109. Accordingly, the screen 117 can remain in the extended position without risk of being inadvertently dislodged from the edges.

Figure 8:
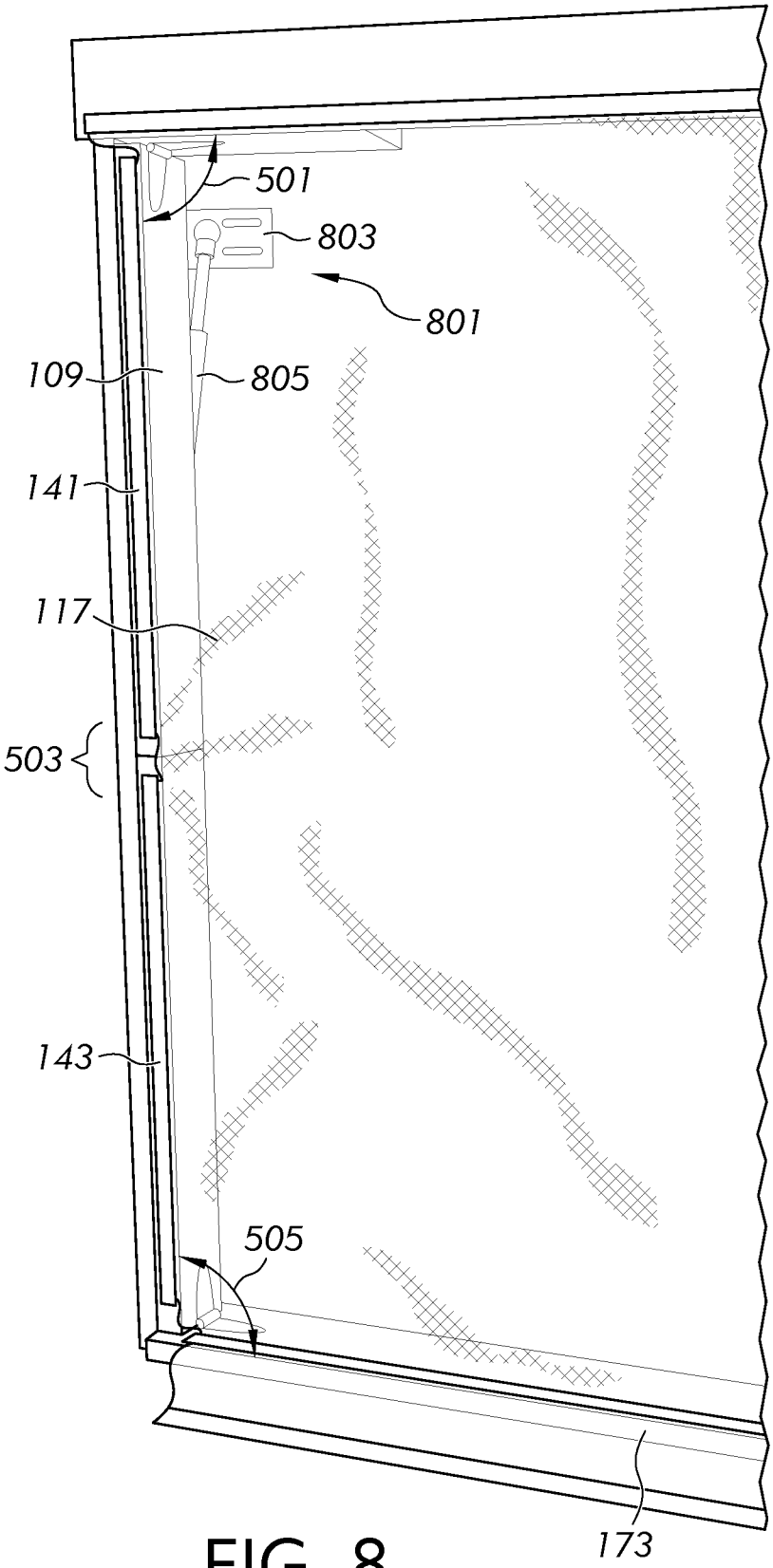
FIG. 8 schematically illustrates a garage door apparatus in accordance with embodiments of the disclosure.

Referring to FIG. 8, in some embodiments, the garage door apparatus 101 can comprise a biasing device 801 that can assist in biasing the screen 117 to the extended or retracted positions and/or can assist in moving the screen 117 in a closed manner. For example, the biasing device 801 can comprise a bracket portion 803 and a biasing portion 805. The bracket portion 803 can be a fixed, non-movable, stationary structure that can be attached to one of the edges of the garage door opening 103, for example, the second edge 107. In some embodiments, one end of the bracket portion 803 can be attached to the second edge 107 while an opposing edge of the bracket portion 803 can extend toward and into the garage door opening 103. The bracket portion 803 can be attached in several ways to the second edge 107, for example, with mechanical fasteners or the like.

In some embodiments, the biasing portion 805 can be attached to the bracket portion 803 at one end of the biasing portion 805 and to the first lateral support arm 135 at an opposing end of the biasing portion 805. The biasing portion 805 can comprise several devices that can facilitate movement of the screen 117. For example, in some embodiments, the biasing portion 805 can comprise a spring, such as a helical spring, a compression spring, a tension spring, etc. In these embodiments, the spring can comprise an elastic object that can store mechanical energy. For example, the spring can be compressed or stretched from a resting position and may exert an opposing force that can be approximately proportional to the change in length of the spring. In this way, when the biasing portion 805 comprises a spring, the biasing portion 805 can assist in maintaining the screen 117 in the extended position (e.g., illustrated in FIG. 6), or may assist in maintaining the screen in the retracted position. The biasing portion 805 is not limited to a spring, however, and may instead comprise a closer (e.g., a mechanical device that allows for movement of a structure, such as the first lateral support arm 135 relative to the second edge 107, in a controlled manner and preventing the structure from slamming after being opened). In the illustrated embodiment of FIG. 8, the biasing portion 805 comprises a pneumatic closer in which a cylinder houses air and a piston rod that moves within the cylinder. The piston rod can comprise a disk that moves within the cylinder. As the piston rod moves, the gas within the cylinder can compress. Accordingly, when the biasing portion 805 comprises a pneumatic closer, the biasing portion 805 can slow the speed at which the first lateral support arm 135 moves (e.g., between the extended and retracted positions) relative to the second edge 107. In some embodiments, the biasing device 801 is not limited to being attached between the second edge 107 and the first lateral support arm 135. Rather, in addition, or in the alternative, a biasing device 801 can be attached between the fourth edge 111 and the second lateral support arm 137.

Figure 4:
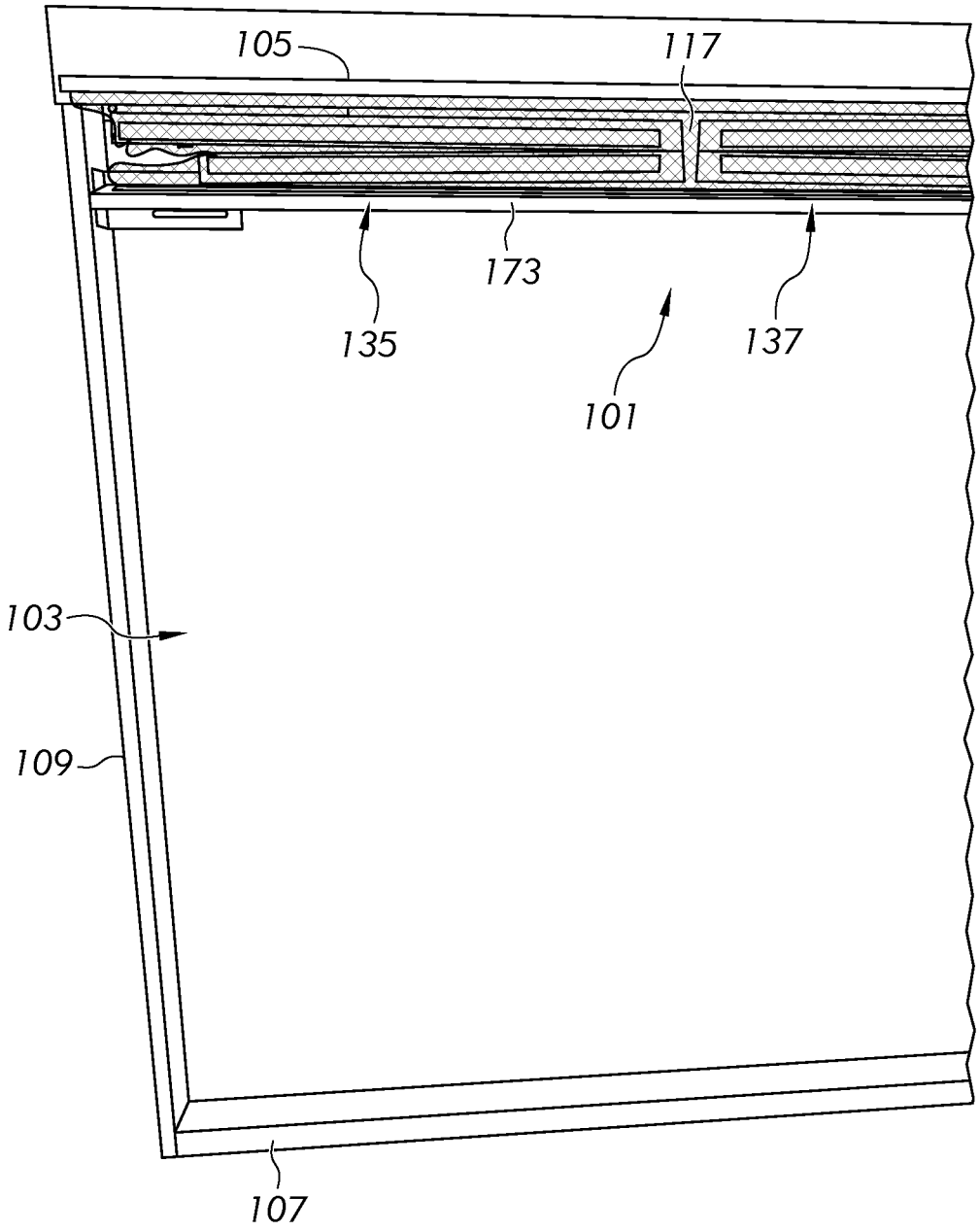
FIG. 4 schematically illustrates a garage door apparatus in accordance with embodiments of the disclosure.
Figure 5:
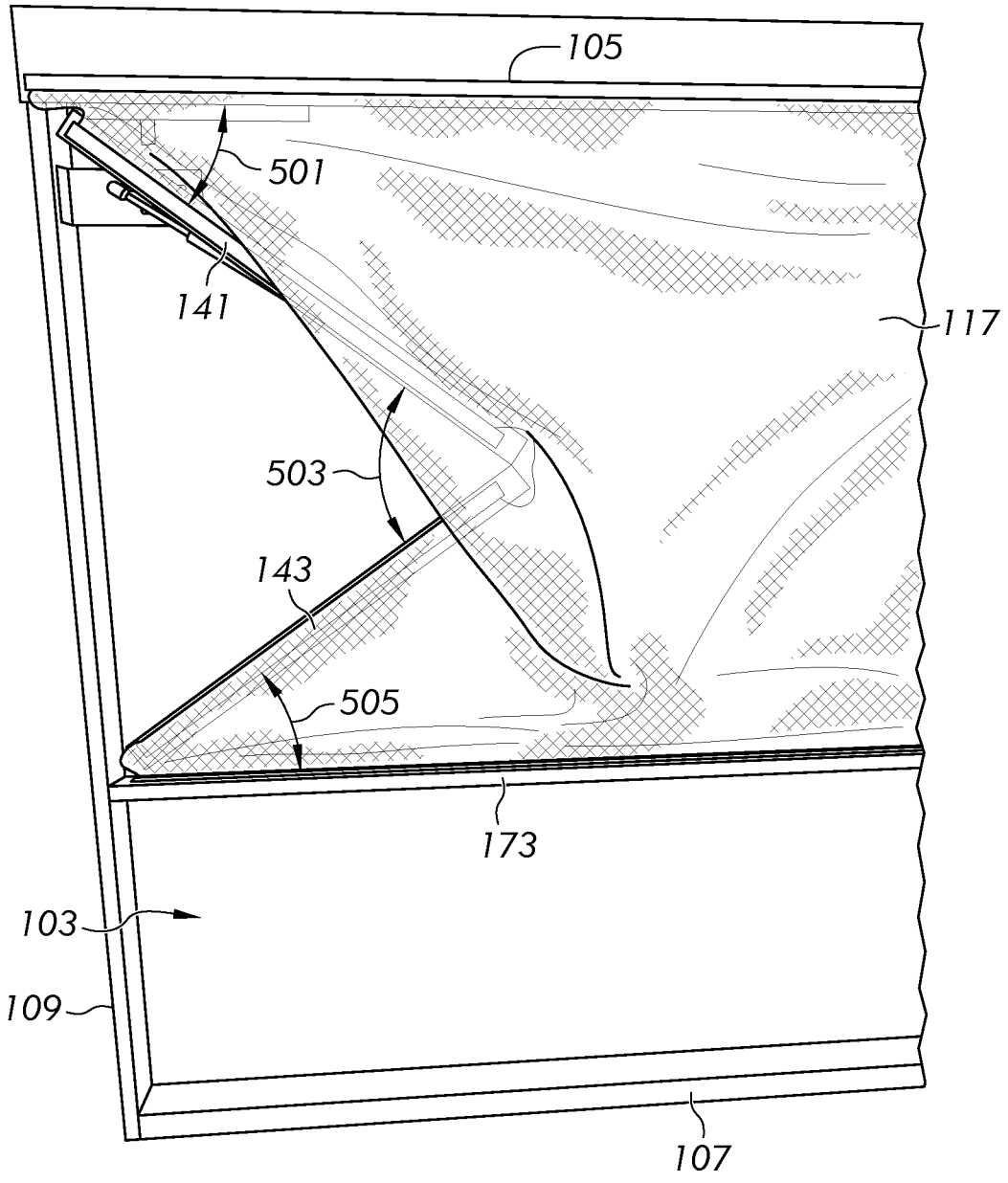
FIG. 5 schematically illustrates a garage door apparatus in accordance with embodiments of the disclosure.

Referring to FIGS. 4-10, the operation of the garage door apparatus 101 is illustrated and may be explained. Initially, in some embodiments and as illustrated in FIG. 4, the garage door apparatus 101 may be in a retracted position such that the screen 117 may not cover the garage door opening 103. Rather, the screen 117 may be compressed (e.g., not extended and non-planar, not stretched, slackened and/or loosened) and stored/located at the top of the garage door opening 103 adjacent to the edge 105. Next, referring to FIG. 5, the screen 117 may be moved from the retracted position toward the extended position. For example, during the movement of the screen 117, the attachment bar 173 may be lowered and the first lateral support arm 135 and the second lateral support arm 137 may be moved from the non-planar, stored position (e.g., illustrated in FIG. 4) to the extended position. For example, the hinged portions 1007 (e.g., illustrated in FIG. 10) can facilitate movement of the attachment arms 141, 143, 157, 158 and the attachment bar 173. For example, in the retracted position of FIG. 4, the attachment arms 141, 143, 157, 158 and the attachment bar 173 may extend parallel to each other with angles defined by the hinged portions 1007 being substantially zero. However, as the attachment bar 173 is lowered, the angles may change. For example, a first angle 501 may be defined between the first attachment arm 141 and the edge 105. A second angle 503 may be defined between the first attachment arm 141 and the second attachment arm 143. A third angle 505 may be defined between the second attachment arm 143 and the attachment bar 173. Similar or identical angles 501, 503, 505 may be formed relative to the third attachment arm 157, the fourth attachment arm 158, and the attachment bar 173. As the attachment bar 173 is lowered from the edge 105 toward the second edge 107, the angles 501, 503, 505 may increase. For example, the first angle 501 may initially be about zero in the retracted position, but may gradually increase to about 90 degrees (e.g., illustrated in FIG. 10) when in the extended position. As illustrated in FIG. 5, in an intermediate position between the retracted position and the extended position, the first angle 501 may be within a range from about 15 degrees to about 60 degrees. Similarly, the second angle 503 may initially be about zero in the retracted position, but may gradually increase to about 180 degrees (e.g., illustrated in FIG. 10) when in the extended position. As illustrated in FIG. 5, in an intermediate position between the retracted position and the extended position, the second angle 503 may be within a range from about 30 degrees to about 90 degrees. The third angle 505 may substantially match the first angle 501 when the attachment bar 173 is parallel to the edge 105. For example, the third angle 505 may initially be about zero in the retracted position, but may gradually increase to about 180 degrees (e.g., illustrated in FIG. 10) when in the extended position. As illustrated in FIG. 5, in an intermediate position between the retracted position and the extended position, the third angle 505 may be within a range from about 15 degrees to about 60 degrees.

Figure 6:
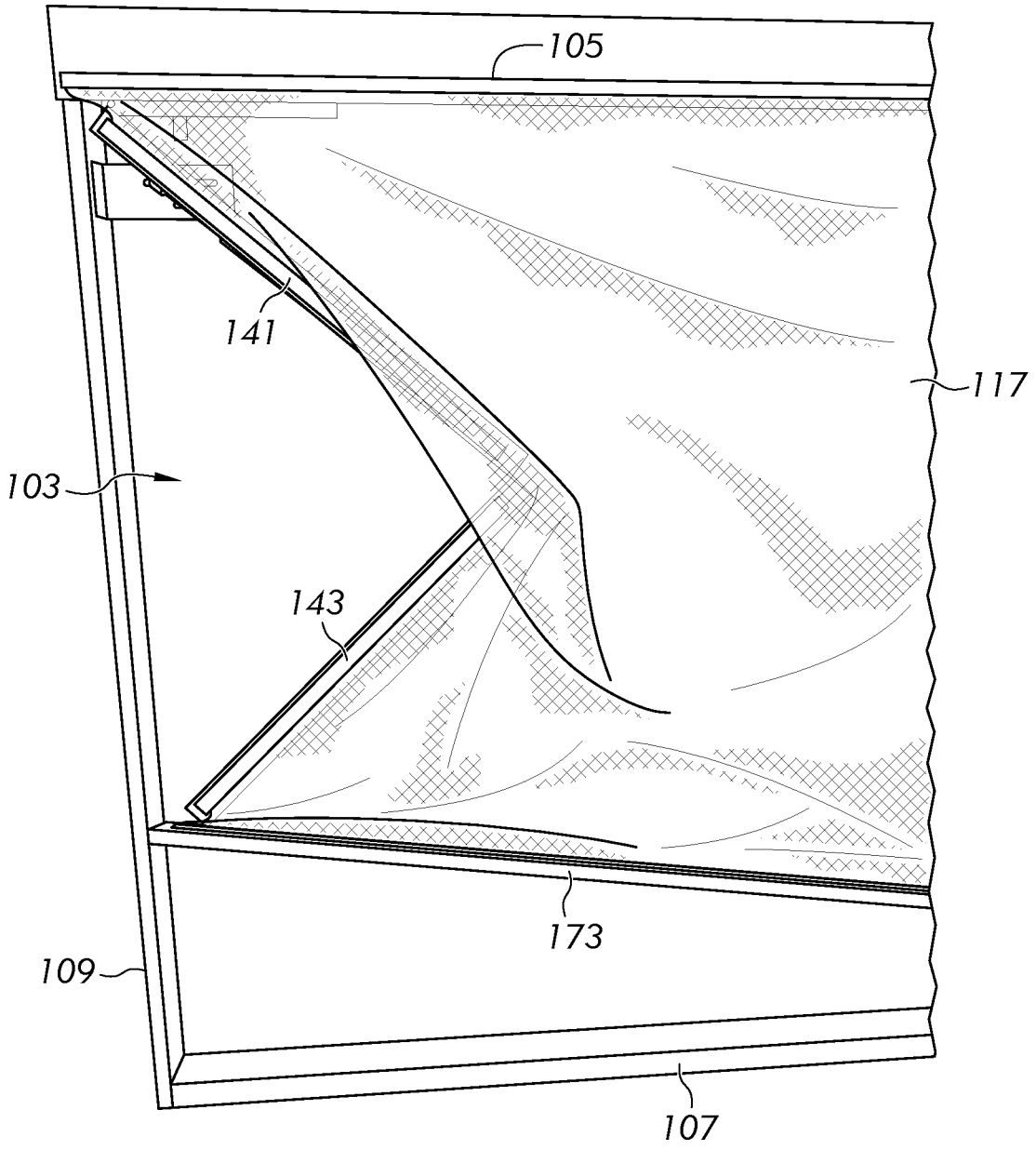
FIG. 6 schematically illustrates a garage door apparatus in accordance with embodiments of the disclosure.
Figure 7:
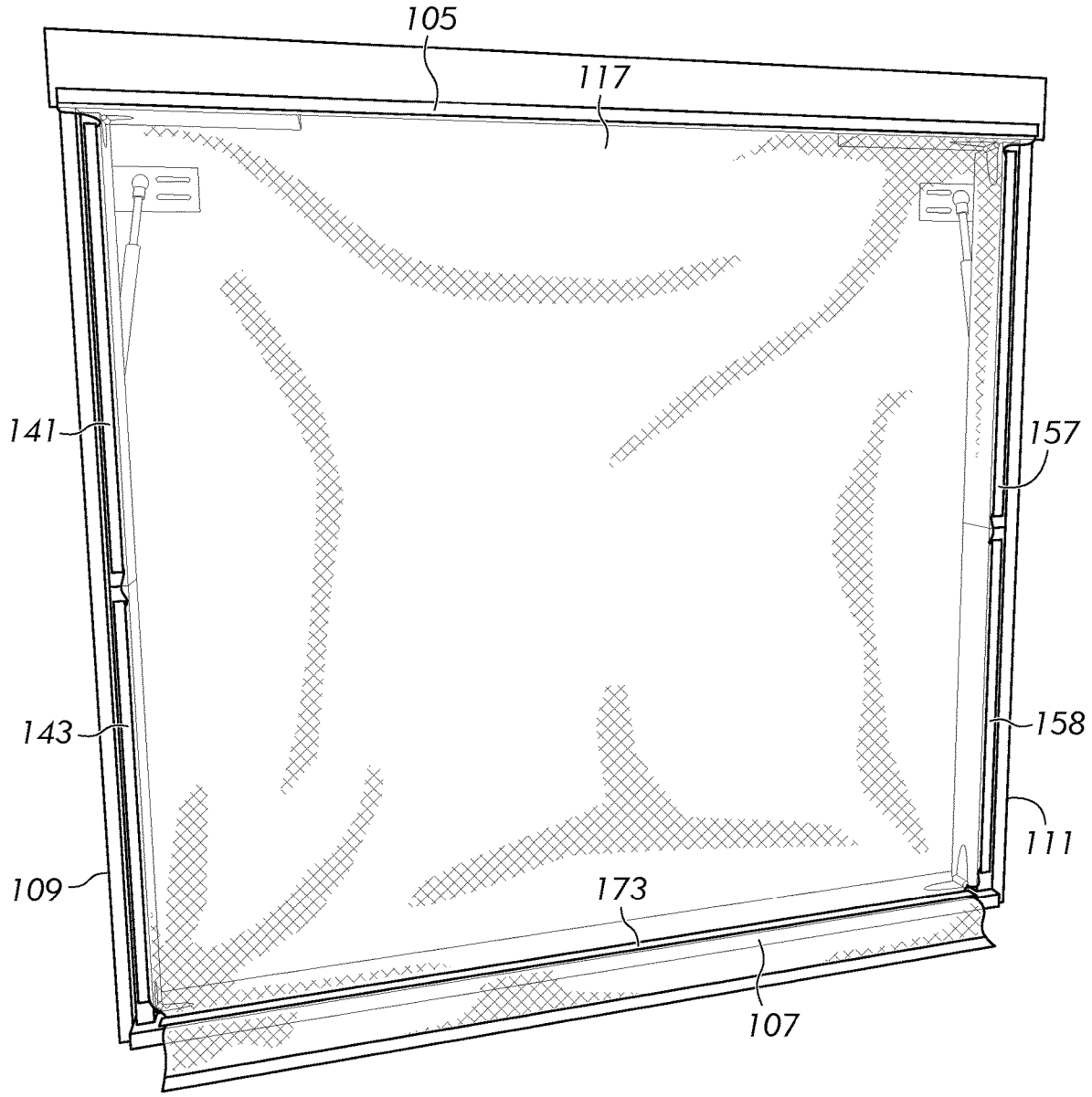
FIG. 7 schematically illustrates a garage door apparatus in accordance with embodiments of the disclosure.

The attachment bar 173 may continue to be lowered, with the attachment bar 173 remaining parallel to the edge 105 (e.g., illustrated in FIG. 5) or non-parallel to the edge 105 (e.g., illustrated in FIG. 6). In the extended/lowered position of FIG. 7, the screen 117 may fully cover the garage door opening 103. To further assist in maintaining the screen 117 in the extended position, the biasing device 801 (e.g., illustrated in FIG. 8) may support the first lateral support arm 135 in the extended position. Likewise, as illustrated in FIG. 9, the support bracket 901 can hold or maintain the first lateral support arm 135 in the extended position with the first lateral support arm 135 positioned within the gap 909.

Figure 11:
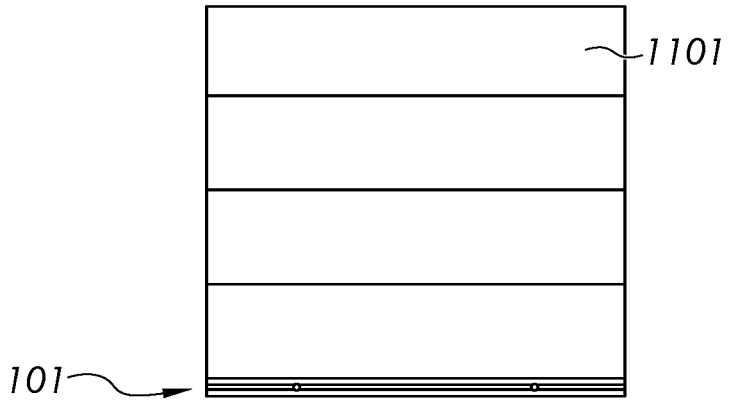
FIG. 11 schematically illustrates a garage door apparatus in accordance with embodiments of the disclosure.
Figure 12:
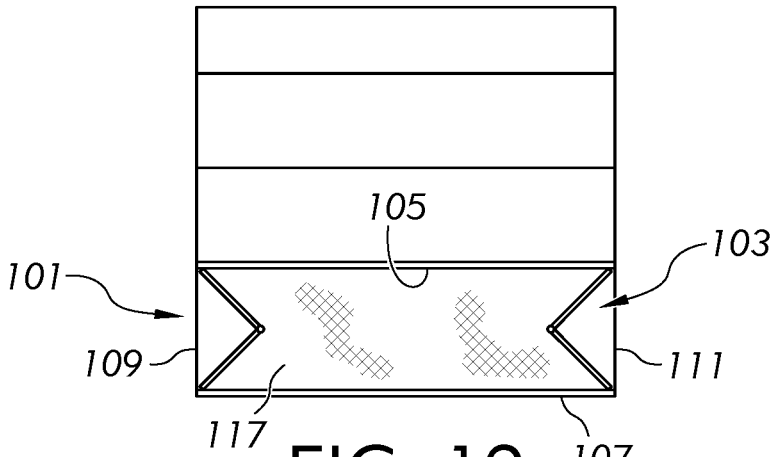
FIG. 12 schematically illustrates a garage door apparatus in accordance with embodiments of the disclosure.
Figure 13:
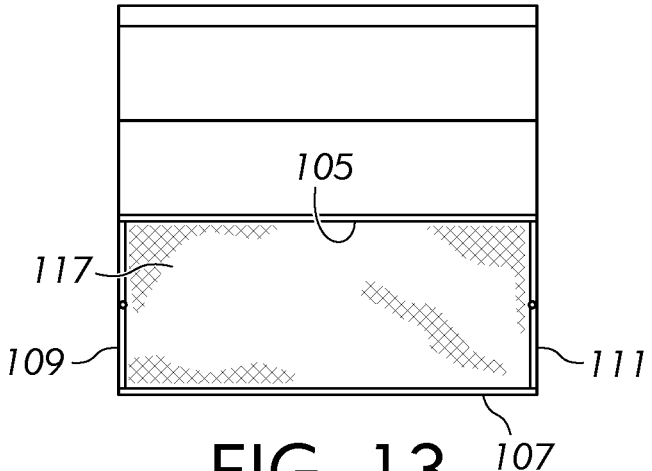
FIG. 13 schematically illustrates a garage door apparatus in accordance with embodiments of the disclosure.

Referring briefly to FIGS. 11-13, the garage door apparatus 101 is not limited to being attached to a wall (e.g., the edge 105) that defines the garage door opening 103. Rather, in some embodiments, the garage door apparatus 101 can be attached to a garage door 1101 that can be moved between a lowered position (e.g., FIG. 11) and a raised position (e.g., FIG. 13). For example, the garage door 1101 can comprise a lower edge that may function as the edge 105 that defines the garage door opening 103 when the garage door 1101 is in the raised position. The structure of the garage door apparatus 101 may be substantially similar or identical to the garage door apparatus 101 described herein relative to FIGS. 1-10. For example, the garage door apparatus 101 may be attached to the edge 107 (e.g., the lower edge) of the garage door 1101. When the garage door 1101 is in the lowered or closed position (e.g., FIG. 11), the garage door 1101 may cover the garage door opening 103 while the screen 117 is compressed, such that the screen 117 does not cover the garage door opening 103. When the garage door 1101 is in the raised or opened position (e.g., FIG. 13), the screen 117 may cover the garage door opening 103. In some embodiments, the screen 117 may be removable from the edge 105 (e.g., relative to some or all of the embodiments illustrated in FIGS. 1-13). By being removable, the screen 117 can be selectively storable when not needed. For example, the screen 117 can be detached from the edge 105 and stored, and may be re-attached to the edge 105 when desired to be in use. The screen 117 can be removed/re-attached in several ways, for example, with mechanical fasteners or the like.

It should be understood that while various embodiments have been described in detail relative to certain illustrative and specific examples thereof, the present disclosure should not be considered limited to such, as numerous modifications and combinations of the disclosed features are possible without departing from the scope of the following claims.

What is claimed is:

1. A garage door apparatus comprising:

a screen comprising a first side, a second side, a third side, and a fourth side, the first side attached to an edge of a garage door opening, the second side, the third side, and the fourth side movable relative to the first side, the screen comprising a flexible, perforated material;

a first attachment arm extending between a first end and a second end, the first end attached to the edge of the garage door opening and the second end projecting into the garage door opening, the first attachment arm attached to a first portion of the second side of the screen;

a second attachment arm extending between a third end and a fourth end, the third end attached to the second end of the first attachment arm, the second attachment arm attached to a second portion of the second side of the screen;

a third attachment arm extending between a fifth end and a sixth end, the fifth end attached to the edge of the garage door opening and the sixth end projecting into the garage door opening, the third attachment arm attached to a first portion of the fourth side of the screen;

a fourth attachment arm extending between a seventh end and an eighth end, the seventh end attached to the sixth end of the third attachment arm, the fourth attachment arm attached to a second portion of the fourth side of the screen; and an attachment bar attached to the third side of the screen and extending across the garage door opening between a first bar end and a second bar end, the first bar end attached to the fourth end of the second attachment arm and the second bar end attached to the eighth end of the fourth attachment arm;

wherein the screen is movable between a retracted position, in which the screen is located along the edge of the garage door opening such that the garage door opening is uncovered and the first attachment arm, the second attachment arm, the third attachment arm, the fourth attachment arm, and the attachment bar extended parallel to each other adjacent to the edge of the garage door opening, and an extended position, in which the screen extends from the edge to cover the garage door opening and the attachment bar extends along a second edge that is opposite the edge.

2. The garage door apparatus of claim 1, wherein the first attachment arm and the second attachment arm are colinear when the screen is in the extended position.

3. The garage door apparatus of claim 2, wherein the first attachment arm and the second attachment arm are substantially parallel to and adjacent to a third edge of the garage door opening.

4. The garage door apparatus of claim 1, wherein the first attachment arm and the second attachment arm are non-colinear when the screen is in the retracted position.

5. The garage door apparatus of claim 1, further comprising an attachment structure attaching the second attachment arm and the attachment bar, the attachment structure comprising a hinged portion wherein the second attachment arm is pivotable relative to the attachment bar.

6. The garage door apparatus of claim 5, wherein the attachment structure comprises a first attachment portion attached to the attachment bar and a second attachment portion attached to the second attachment arm.

7. A garage door apparatus comprising:

a screen comprising a first side, a second side, a third side, and a fourth side, the first side attached to an edge of a garage door opening, the second side, the third side, and the fourth side movable relative to the first side, the screen comprising a flexible, perforated material;

a first attachment arm extending between a first end and a second end, the first end attached to the edge of the garage door opening and the second end projecting into the garage door opening, the first attachment arm attached to a first portion of the second side of the screen;

a second attachment arm extending between a third end and a fourth end, the third end attached to the second end of the first attachment arm, the second attachment arm attached to a second portion of the second side of the screen;

a third attachment arm extending between a fifth end and a sixth end, the fifth end attached to the edge of the garage door opening and the sixth end projecting into the garage door opening, the third attachment arm attached to a first portion of the fourth side of the screen;

a fourth attachment arm extending between a seventh end and an eighth end, the seventh end attached to the sixth end of the third attachment arm, the fourth attachment arm attached to a second portion of the fourth side of the screen;

an attachment bar attached to the third side of the screen and extending across the garage door opening between a first bar end and a second bar end, the first bar end attached to the fourth end of the second attachment arm and the second bar end attached to the eighth end of the fourth attachment arm;

wherein the screen is movable between a retracted position, in which the screen is located along the edge of the garage door opening such that the garage door opening is uncovered, and an extended position, in which the screen extends from the edge to cover the garage door opening and the attachment bar extends along a second edge that is opposite the edge.

8. The garage door apparatus of claim 7, wherein the first attachment arm and the second attachment arm are colinear when the screen is in the extended position.

9. The garage door apparatus of claim 8, wherein the first attachment arm and the second attachment arm are substantially parallel to and adjacent to a third edge of the garage door opening.

10. The garage door apparatus of claim 7, wherein the first attachment arm and the second attachment arm are non-colinear when the screen is in the retracted position.

11. The garage door apparatus of claim 7, further comprising an attachment structure attaching the second attachment arm and the attachment bar, the attachment structure comprising a hinged portion wherein the second attachment arm is pivotable relative to the attachment bar.

12. The garage door apparatus of claim 11, wherein the attachment structure comprises a first attachment portion attached to the attachment bar and a second attachment portion attached to the second attachment arm.

13. A garage door apparatus comprising:

a screen comprising a first side, a second side, a third side, and a fourth side, the first side attached to an edge of a garage door opening, the second side, the third side, and the fourth side movable relative to the first side, the screen comprising a flexible material;

a first lateral support arm attached at one end to the edge of the garage door opening and at an opposing end to a first bar end of an attachment bar, the first lateral support arm attached to the second side of the screen;

a second lateral support arm attached at one end to the edge of the garage door opening and at an opposing end to a second bar end of the attachment bar, the second lateral support arm attached to the fourth side of the screen;

an attachment structure attaching the first lateral support arm and the attachment bar, the attachment structure comprising a hinged portion wherein the first lateral support arm is pivotable relative to the attachment bar;

wherein the attachment bar is attached to the third side of the screen and extends across the garage door opening between the first bar end and the second bar end, and wherein the screen is configured to move between a retracted position, in which the screen is compressed such that the garage door opening is uncovered by the screen, and an extended position, in which the screen extends from the edge to cover the garage door opening such that the screen is substantially planar.

14. The garage door apparatus of claim 13, wherein the first lateral support arm extends linearly when the screen is in the extended position.

15. The garage door apparatus of claim 14, wherein the first lateral support arm is substantially parallel to and adjacent to a third edge of the garage door opening.

16. The garage door apparatus of claim 13, wherein the first lateral support arm is non-linear when the screen is in the retracted position.

17. The garage door apparatus of claim 13, wherein the attachment structure comprises a first attachment portion attached to the attachment bar and a second attachment portion attached to the first lateral support arm.

* * * * *